US007930787B2

(12) United States Patent
La Belle et al.

(10) Patent No.: US 7,930,787 B2
(45) Date of Patent: Apr. 26, 2011

(54) METHOD FOR DETERMINING LOAD SIZE AND/OR SETTING WATER LEVEL IN A WASHING MACHINE

(75) Inventors: Kathleen M. La Belle, Lawrence, MI (US); Jenn-Yeu Nieh, Saint Joseph, MI (US); Laura C. Oskins, Saint Joseph, MI (US); Bennett J. Cook, Watervliet, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 457 days.

(21) Appl. No.: 12/058,865

(22) Filed: Mar. 31, 2008

(65) Prior Publication Data

US 2009/0241271 A1 Oct. 1, 2009

(51) Int. Cl.
*D06F 33/02* (2006.01)

(52) U.S. Cl. ..... 8/159; 68/12.05; 68/12.04; 68/12.21

(58) Field of Classification Search ..... 8/159; 68/12.05, 68/12.04, 12.21
See application file for complete search history.

(56) References Cited

U.S. PATENT DOCUMENTS

| | | | | |
|---|---|---|---|---|
| 4,303,406 | A | 12/1981 | Ross | |
| 4,321,809 | A * | 3/1982 | Bochan | 68/207 |
| 4,400,838 | A | 8/1983 | Steers et al. | |
| 4,503,575 | A | 3/1985 | Knoop et al. | |
| 4,528,709 | A | 7/1985 | Getz et al. | |
| 4,697,293 | A * | 10/1987 | Knoop | 8/158 |
| 4,733,547 | A | 3/1988 | Honda | |
| 4,835,991 | A | 6/1989 | Knoop et al. | |
| 4,862,710 | A * | 9/1989 | Torita et al. | 68/12.01 |
| 5,144,819 | A * | 9/1992 | Hiyama et al. | 68/12.04 |
| 5,161,393 | A * | 11/1992 | Payne et al. | 68/12.04 |
| 5,230,228 | A * | 7/1993 | Nakano et al. | 68/12.04 |
| 5,577,283 | A * | 11/1996 | Badami et al. | 8/158 |
| 5,768,728 | A * | 6/1998 | Harwood et al. | 8/158 |
| 5,768,729 | A | 6/1998 | Cracraft | |
| 6,023,950 | A | 2/2000 | Battistella | |
| 6,151,742 | A | 11/2000 | Dausch et al. | |
| 6,292,966 | B1 | 9/2001 | Lim et al. | |
| 6,460,381 | B1 | 10/2002 | Yoshida et al. | |
| 2003/0041390 | A1 | 3/2003 | Kim et al. | |
| 2005/0257575 | A1 | 11/2005 | Kang et al. | |
| 2006/0283214 | A1 | 12/2006 | Donadon et al. | |

(Continued)

FOREIGN PATENT DOCUMENTS

DE 30 30 491 * 2/1982

(Continued)

OTHER PUBLICATIONS

European Patent Office 0 787 484 Aug. 1997.*

*Primary Examiner* — Frankie L Stinson
(74) *Attorney, Agent, or Firm* — Clifton G. Green; McGarry Bair PC

(57) ABSTRACT

In a washing machine comprising a tub, an agitator, and a pressure sensor, a size of a fabric load may be determined and/or an operational water level may be set based on an amount of water supplied to reach a first level in the tub and on variation in an output from the pressure sensor during agitation of the water and fabric load with the water at a second level in the tub.

24 Claims, 7 Drawing Sheets

U.S. PATENT DOCUMENTS

2008/0189875 A1* 8/2008 Czyzewski et al. ..... 8/159

FOREIGN PATENT DOCUMENTS

| | | | | |
|---|---|---|---|---|
| DE | 3309101 | A1 | | 9/1984 |
| DE | 3837202 | A1 | | 5/1990 |
| DE | 3842996 | A1 | | 7/1990 |
| DE | 41 22 307 | | * | 1/1993 |
| DE | 4122307 | A1 | | 1/1993 |
| DE | 4242414 | A1 | | 6/1994 |
| DE | 10 2006 030 891 | | * | 1/2008 |
| EP | 0644291 | A1 | | 3/1995 |
| GB | 2051413 | A | | 1/1981 |
| JP | 64-087000 | | * | 3/1980 |
| JP | 61-094684 | | * | 5/1986 |
| JP | 63-040596 | | * | 2/1988 |
| JP | 02-164396 | | * | 6/1990 |
| JP | 02-286197 | | * | 11/1990 |
| JP | 05-084393 | | * | 4/1993 |
| JP | 05-168790 | | * | 7/1993 |
| JP | 08-173681 | | * | 7/1996 |
| JP | 08-323089 | | * | 12/1996 |
| JP | 2001-137592 | | * | 5/2001 |

* cited by examiner

METHOD FOR DETERMINING LOAD SIZE AND/OR SETTING WATER LEVEL IN A WASHING MACHINE

BACKGROUND OF THE INVENTION

The invention relates to a method for determining load size and/or setting a water level in a washing machine. For a wash process of a washing machine, the water level in the tub is typically set based on the size of a fabric load and, sometimes, the fabric type of the fabric load. The size of the fabric load may be manually input by the user through a user interface or may be automatically determined by the washing machine. For manual input by the user, the user may oftentimes overestimate or underestimate the load size, thereby resulting in too much or too little water, respectively, for the wash process. Too much water is wasteful, and too little water may lead to an insufficient wash performance. Many methods are known for the washing machine to automatically determine the load size and/or fabric type, such as by employing an output of the motor that drives the drum within the tub and the agitator within the drum. However, some lower end washing machines have motors that do not provide output useful for determining load size or have other limitations that preclude or make undesirable known methods for automatically determining load size.

SUMMARY OF THE INVENTION

A method according to one embodiment for determining a size of a fabric load in a washing machine comprising a wash tub, an agitator for agitating a fabric load in the tub, and a pressure sensor for sensing a level of water in the tub comprises determining a first qualitative load size of the fabric load based on a volume of water supplied to the tub to reach a first level in the tub, and, if the volume of water supplied is not indicative of the first qualitative load size, determining a second qualitative load size of the fabric load based on a variation in an output of the pressure sensor during agitation the fabric load with water in the tub.

DESCRIPTION OF EMBODIMENTS OF THE INVENTION

Figure 1:
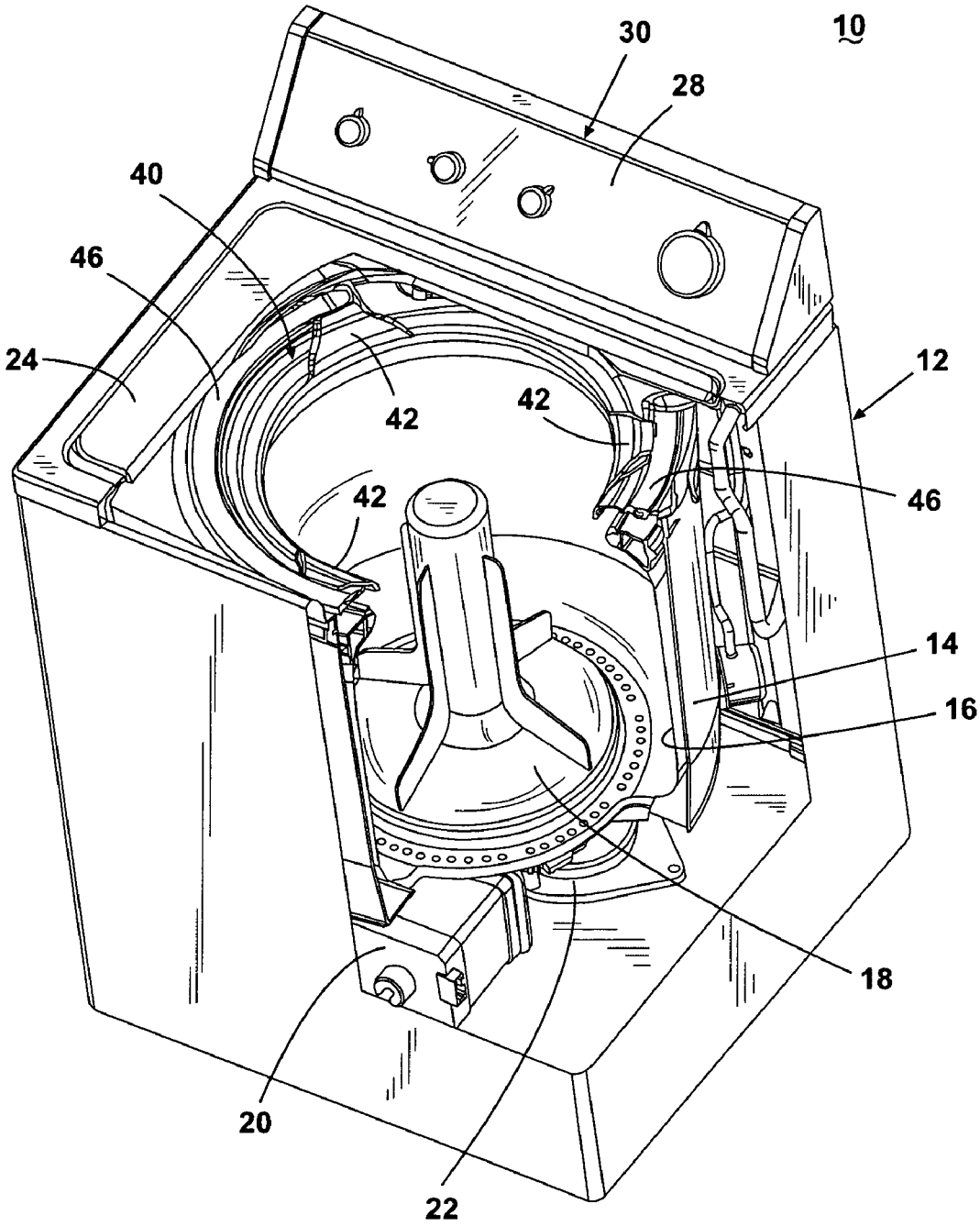
FIG. 1 is a front perspective view of an exemplary washing machine according to one embodiment of the invention with a portion cut-away to show interior components of the washing machine.

Referring now to the figures, FIG. 1 is a schematic view of an exemplary washing machine 10 according to one embodiment of the invention. The methods described herein may be used with any suitable washing machine and are not limited to use with the washing machine 10 described below and shown in the drawings. The washing machine 10 is described and shown for illustrative purposes.

The washing machine 10 includes a cabinet or housing 12, an imperforate tub 14, a perforated basket or drum 16 mounted within and rotatable relative to the tub 14, an agitator 18 mounted within and rotatable relative to and/or with the basket 16, and an electrically driven motor 20 operably connected via a transmission 22 to the agitator 18 and/or the basket 16. The transmission 22 may be a gear driven direct drive. The motor may be a brushless permanent magnet (BPM) motor direct drive, which may be coupled to and drive the transmission. An openable lid 24 on the top of the cabinet 12 provides access into the basket 16 through the baskets' open top. A user interface 28, which may be located on a console 30, may include one or more knobs, switches, displays, and the like for communicating with the user, such as to receive input and provide output.

A spraying system 40 may be provided to spray liquid (water or a combination of water and one or more wash aids) into the open top of the basket 16 and on top of any fabric load placed within the basket 16. The spraying system 40 may be configured to supply water directly from a household water supply and/or from the tub and spray it onto the fabric load. The spraying system 40 may also be configured to recirculate liquid from the tub, include a sump in the tub, and spray it onto the top of the fabric load. Other embodiments of the invention may use other water delivery techniques known to those skilled in the art.

As illustrated, the spraying system 40 may have one or more spray heads 42 directed into the open top of the basket 16. A liquid supply line (not shown) supplies liquid to a distribution manifold 46 integrated with the balancing ring to effect the supply of liquid to the spray heads 42. The supply line may be fluidly coupled to either or both of the household water supply or the tub as previously described. When liquid is supplied to the supply line from either the household supply or the tub, the liquid is directed to the spray heads 42 through the manifold 46 and is then emitted through the spray heads 42 into the open top of the basket 16 and onto any fabric load in the basket 16.

If the number, location, and coverage of the spray heads 42 is insufficient to substantially cover the basket 16, the basket may be rotated so that the fabric load is rotated beneath the spray heads for a more even wetting. However, the spray heads 42 as illustrated may be located and their spray coverage controlled such that they sufficiently evenly wet the fabric load in the basket without the need for rotating the basket, which likely reduces the cost and complexity of the motor, transmission, and controller.

Figure 2:
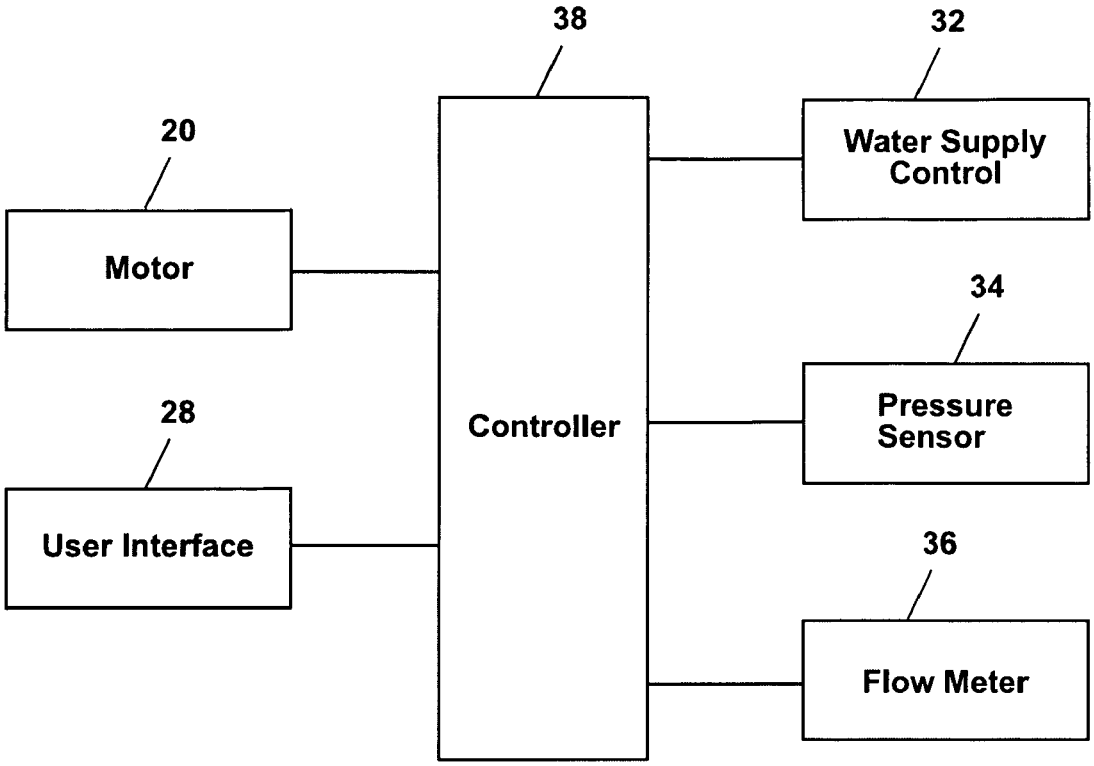
FIG. 2 is a schematic view of a control system according to one embodiment of the invention for the washing machine of FIG. 1.

Referring now to FIG. 2, the washing machine 10 further includes a water supply control 32, a pressure sensor 34, and a timer 36. The water supply control 32 may include one or more valves, pumps, and/or other flow control devices operable to selectively fluidly communicate an external water supply (not shown) with the tub 14 or the spraying system 40. When the water supply control 32 controls the supply of water to the tub, the level of water in the tub 14 may be detected by the pressure sensor 34, which may be positioned in any suitable location for detection of the water level in the tub 14. The pressure sensor 34 may be any suitable type of pressure sensor, including a dome-type pressure sensor, as is well-known in the art. The timer 36 may be employed to time one or more processes in the washing machine 10, including a time of supplying water to the tub 14.

A controller 38 communicates with several working components and/or sensors in the washing machine 10, such as the motor 20, the user interface 28, the water supply control 32, the pressure sensor 34, and the flow meter 36, to receive data from one or more of the working components or sensors and may provide commands, which may be based on the received data, to one or more of the working components to execute a desired operation of the washing machine 10. The commands may be data and/or an electrical signal without data. The controller 38 may also convert the data from the flow meter 36 to volume of water supplied to the tub 14 if the volume of water supplied to the tub 14 is not directly provided by the flow meter 36. The washing machine 10 may further include a timer to provide time data to the controller 38 to assist in the conversion of the flow rate data to volume of water supplied to the tub 14. Many known types of controllers may be used for the controller 38. The specific type of controller is not germane to the invention.

The washing machine 10 shown in the figures and described herein is a vertical axis washing machine. As used herein, the "vertical axis" washing machine refers to a washing machine having a rotatable drum that rotates about a generally vertical axis relative to a surface that supports the washing machine. However, the rotational axis need not be vertical; the drum may rotate about an axis inclined relative to the vertical axis. Typically, the drum is perforate or imperforate and holds fabric items and a fabric moving element, such as an agitator, impeller, pulsator, infuser, nutator, ribbing or baffles on the interior wall of the basket or drum 16, and the like, that induces movement of the fabric items to impart mechanical energy directly to the fabric articles or indirectly through wash water in the drum for cleaning action. The clothes mover is typically moved in a reciprocating rotational movement, although non-reciprocating movement is also possible.

Although the washing machine 10 is a vertical axis washing machine, the methods described below may be employed in any suitable washing machine having a fabric moving element, including washing machines other than vertical axis washing machines. As used herein, "agitator" refers to any type of fabric moving element and is not limited to the structure commonly associated with an agitator, such as the structure shown in FIG. 1. Similarly, "agitate" refers to moving the fabric items and/or the water, regardless of the type of fabric mover inducing the movement of the fabric items and the type of motion of the fabric mover to induce the movement.

Typically, a washing machine performs one or more manual or automatic operation cycles, and a common operation cycle includes a wash process, a rinse process, and a spin extraction process. Other processes for operation cycles include, but are not limited to, intermediate extraction processes, such as between the wash and rinse processes, and a pre-wash process preceding the wash process, and some operation cycles include only a select one or more of these exemplary processes. Regardless of the processes employed in the operation cycle, the methods described below relate to determining a size of the fabric load and/or setting an operational water level for a process in the operation cycle.

Figure 3:
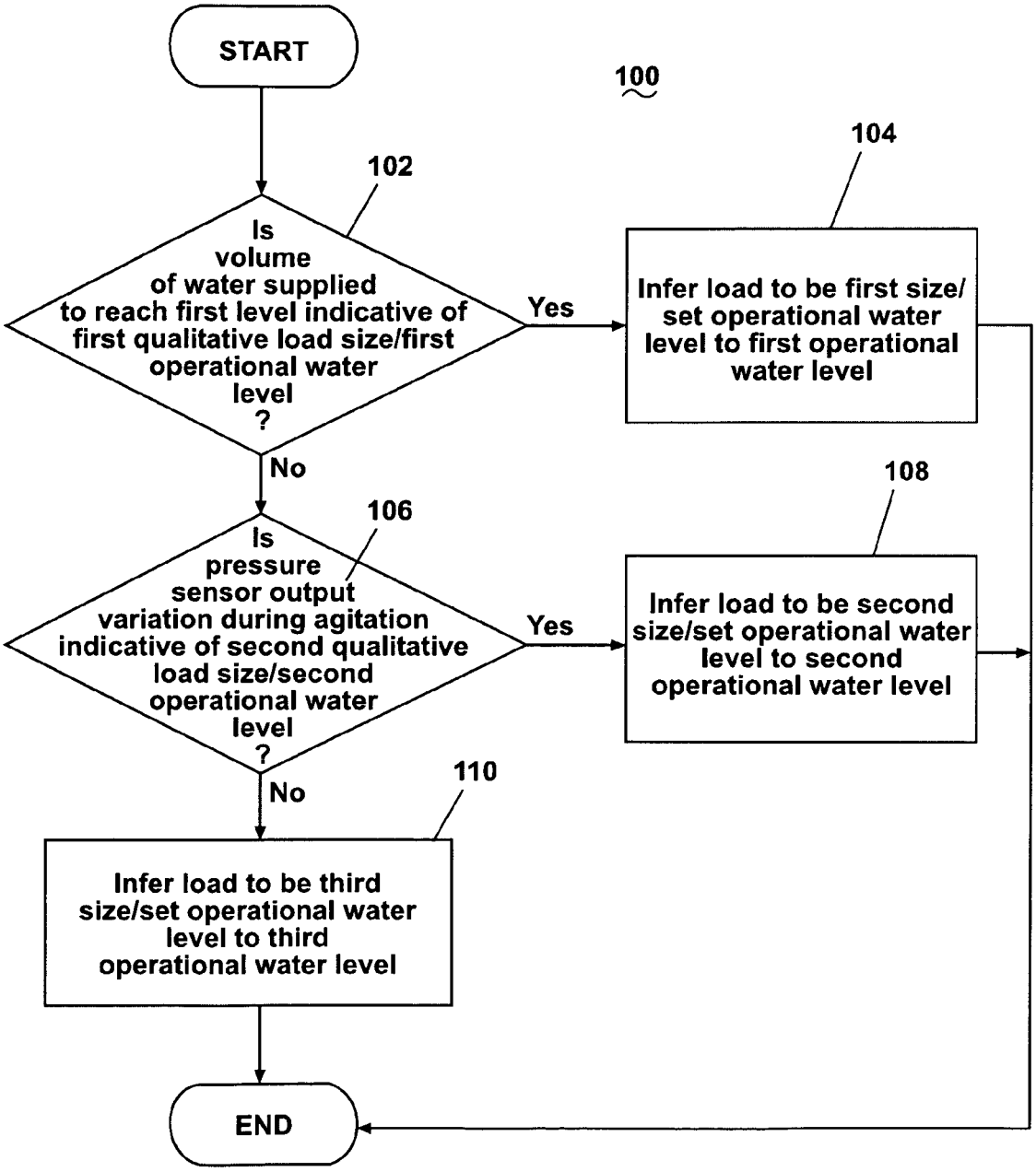
FIG. 3 is an exemplary flow chart of a method for determining load size and/or setting an operational water level in the washing machine of FIG. 1 according to one embodiment of the invention.

FIG. 3 provides a flow chart corresponding to a method 100 of operating the washing machine 10 according to one embodiment of the invention. The method 100 may be implemented in any suitable manner, such as in an automatic or manual operation cycle of the washing machine 10. The method 100 may be conducted as part of a wash process or other suitable process, such as a pre-wash or rinse process, of the operation cycle. Regardless of the implementation of the method 100, the method 100 may be employed to determine a size of the fabric load and/or set an operational water level for the associated process, which will be described as the wash process hereinafter for illustrative purposes.

The flow chart in FIG. 3 provides an overview of the method 100 according to one embodiment of the invention. The method 100 begins with a first determination at a step 102 of whether a volume of water sprayed onto the laundry to reach a first level in the tub 14 is indicative of a first qualitative load size. If the volume of water is indicative of the first qualitative load size, then the operational water level is set at step 104. An operational water level is a level of the volume of water used in the wash cycle for the determined load size. In one embodiment, the first qualitative load size may include multiple load sizes, each having a corresponding operational water level, and the method 100 may further include steps of selecting the first qualitative load size and/or the first operational water level from the multiple load sizes/operational water levels. An example of selecting the first qualitative load size and/or the first operational water level from the multiple load sizes/operational water levels is provided below.

On the other hand, if the volume of water supplied is not indicative of the first qualitative load size, then the method 100 proceeds with a determination at a step 106 of whether a variation in output of the pressure sensor 34 during agitation is indicative of a second qualitative load size greater than the first qualitative load size. If the volume of water supplied is indicative of the first qualitative load size, then the operational water level is set at a step 108 to a second operational water level. In one embodiment, as with the first qualitative load size, the second qualitative load size may include multiple load sizes, each having a corresponding operational water level, and the method 100 may further include steps of selecting the second operational load size and/or second operational water level from the multiple load sizes/operational water levels. An example of selecting the second qualitative load size and/or second operational water level from the multiple load sizes/operational water levels is provided below.

Alternatively, if the variation in the output of the pressure sensor 34 during agitation is not indicative of the second qualitative load size, then the load size is determined at step 110 to be a third qualitative load size, and the operational water level is set to a third operational water level. When the first qualitative load size includes the multiple load sizes, the third qualitative load size may be one of the multiple load sizes, an example of which is provided below. After the load size is determined and/or the operational water level is set, the process associated with the method 100 continues in any desired manner.

The term operational water level is used to reference the level of water in the tub corresponding to a volume of water for implementing one or more steps of a wash cycle. The term operational water level is to be distinguished from the term water level, which is used to reference any water level in the tub and expressly includes operational water levels.

Figure 4:
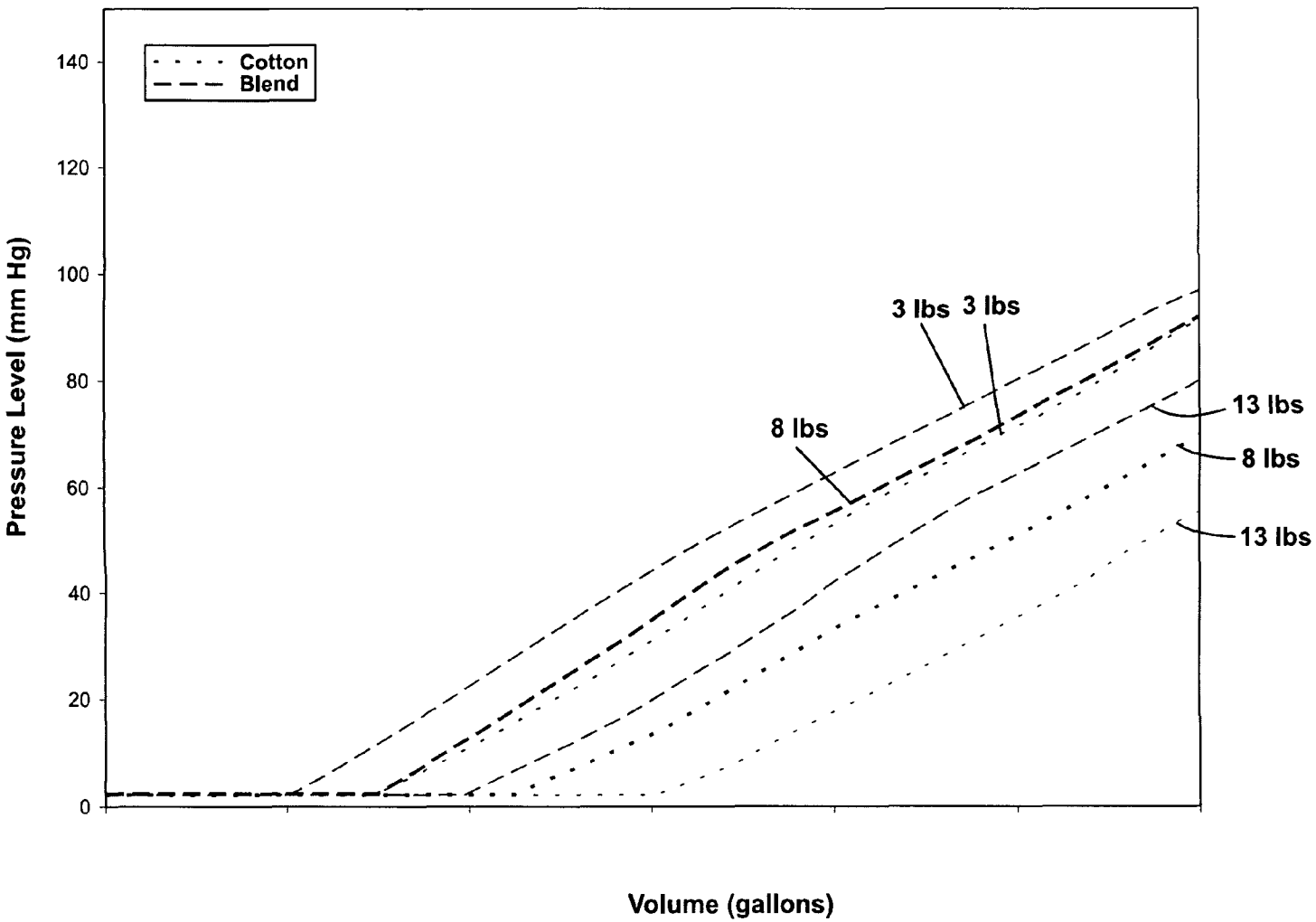
FIG. 4 is an exemplary graph of pressure level as a function of volume of water supplied for an initial water supply illustrating volume of water supplied to reach a first level for various fabric load weights having various fabric types.

Referring generally to FIG. 4, the logic underlying the method of the invention will be explained. The amount of water absorbed by the fabric load during the initial fill has been found to be indicative of the relative load size, such as whether the load is a relatively small size or is larger or smaller than another load. For similar types of fabrics, a smaller fabric load absorbs less water than a larger fabric load. Assuming all other things are equal, the result is that for a small load as compared to large load, it takes less water sprayed on the laundry before the water starts collecting in the tub. Therefore, the volume of water sprayed onto the laundry necessary for the water to start collecting in the tub or to collect to a predetermined water level in the tub, the initial supplied volume, may be used as an indicator of the size of load.

There may not an exact correlation between the initial supplied volume and the load size because of environmental factors. For example, if the load is small enough, it may not cover the bottom of the basket 16 and the water would pass directly from the spraying system 40 and into the tub. This may be referred to as the water bypassing the clothing, which tends to result in the initial supplied volume indicating a smaller load than is present. The fabric load may also be placed in the basket 16 in such a way that water will pool on the fabric and not be absorbed, which tends to result in the initial supplied volume indicating a larger load than is present. The mix of fabrics in the fabric load may also affect the initial supplied volume. For example, a fabric load of synthetic fabrics typically absorbs less water than the same size fabric load of cotton fabrics; thus, the initial supplied volume may be less for the synthetic fabric load than for the cotton fabric load. These potential errors in the accuracy of the time to fill and the actual load size may be addressed by the selection of operational water levels that span any anticipated error.

While the initial supplied volume may be determined by filling to any water level, to minimize the cycle time, the initial supplied volume determination may be measured until the pressure sensor first begins to sense water in the tub, which is sometimes referred to as the first meaningful output from the pressure sensor 34. The first meaningful output of the pressure sensor typically corresponds to a water level in the tub. That is, it is the first sensed water level that the pressure sensor can sense. This first sensed water level depends, at least in part, on the configuration of the washing machine 10, such as the location of the pressure sensor 34. Alternatively, the first sensed water level may correspond to a predetermined output from the pressure sensor 34, which is indicative of a water level above the first sensed water level. However, determining the initial spayed volume at a water level above the first sensed water level will increase the overall cycle time. The first sensed water level may be less than, equal to, or greater than a level of water for a wash process of an operation cycle of the washing machine 10. As one example, the first sensed water level may be about 1 inch of water in the tub 14. For purposes of this description, the initial supplied volume will be described in the context of the reaching the first water level, with it being understood that any water level may be used as the level for determining the initial supplied volume. Therefore, the term initial supplied volume will be used to generically refer to the water level reaches the first water level that is used for testing, which for the illustrated embodiment is the first water level that can be sensed, with it being understood that this term may apply to any water level and not limited by the manner in which the water level is sensed.

The relationship between load size and initial supplied volume is illustrated in FIG. 4, which contains example plots of pressure verses supplied water volume for different combinations of load sizes and load types as water is being introduced onto the fabric load. The pressure sensor used for the plots is a dome-type pressure sensor located in the tub 14 beneath the basket 16. The illustrated load sizes are 3 lb, 8 lb, and 13 lb. The illustrated load types are a blend (shown in dashed lines) of cotton and synthetic fabrics and a 100% cotton load (shown in dotted lines). Each combination of load size and load type is represented by a different plot line. For ease of viewing, transient variations in the actual test data have been removed from the plots and only the general trend is plotted.

Each plot line has the same general shape where the pressure remains constant (horizontal portion) and then, at an inflection point, trends upwardly (angled portion). The horizontal portion represents the when water is being added to the basket 16 but the pressure sensor does not yet sense any water in the tub. Most of the water during this time is being absorbed by the fabric load. The inflection point represents the time when the sensor first senses water in the tub and is when the initial supplied volume is determined. After the inflection point is reached, most of the additional water is not absorbed by the fabric load and goes into the tub, resulting in an increase in the water level, which results in an increased pressure sensed by the pressure sensor.

In comparing the various plots, it can be seen that for a given fabric load type, the supplied volume of water necessary to reach the inflection point, i.e., the initial spray volume, increases with load size. This is true for either the blend load type or the all cotton load type. Therefore, the initial spray volume may be used to determine relative load sizes.

It can also be seen that in some instances the absolute nature of the correlation does not hold true if there is when there is a large difference in the absorbency of the fabric types. For example, the 3 lb cotton load reaches its inflection point about the same time as the 8 lb blend load, and the 8 lb cotton load reaches its inflection point after the 13 lb blend load. To address the variation attributable to the absorbency variation of the load types, the initial spray volume and corresponding operation water level may be selected to obtain the best/desired wash performance. For example, in a vertical axis machine, operational water levels are usually set based on the weight of the fabric load and it is generally considered better to have too much water for a given load weight than too little water because it minimizes the wear on the clothing from the agitator and has better wash performance. Therefore, the inflection points for the blend loads may be used as indicators for the cotton loads to ensure that enough water is added when setting the operational water level.

Figure 5A:
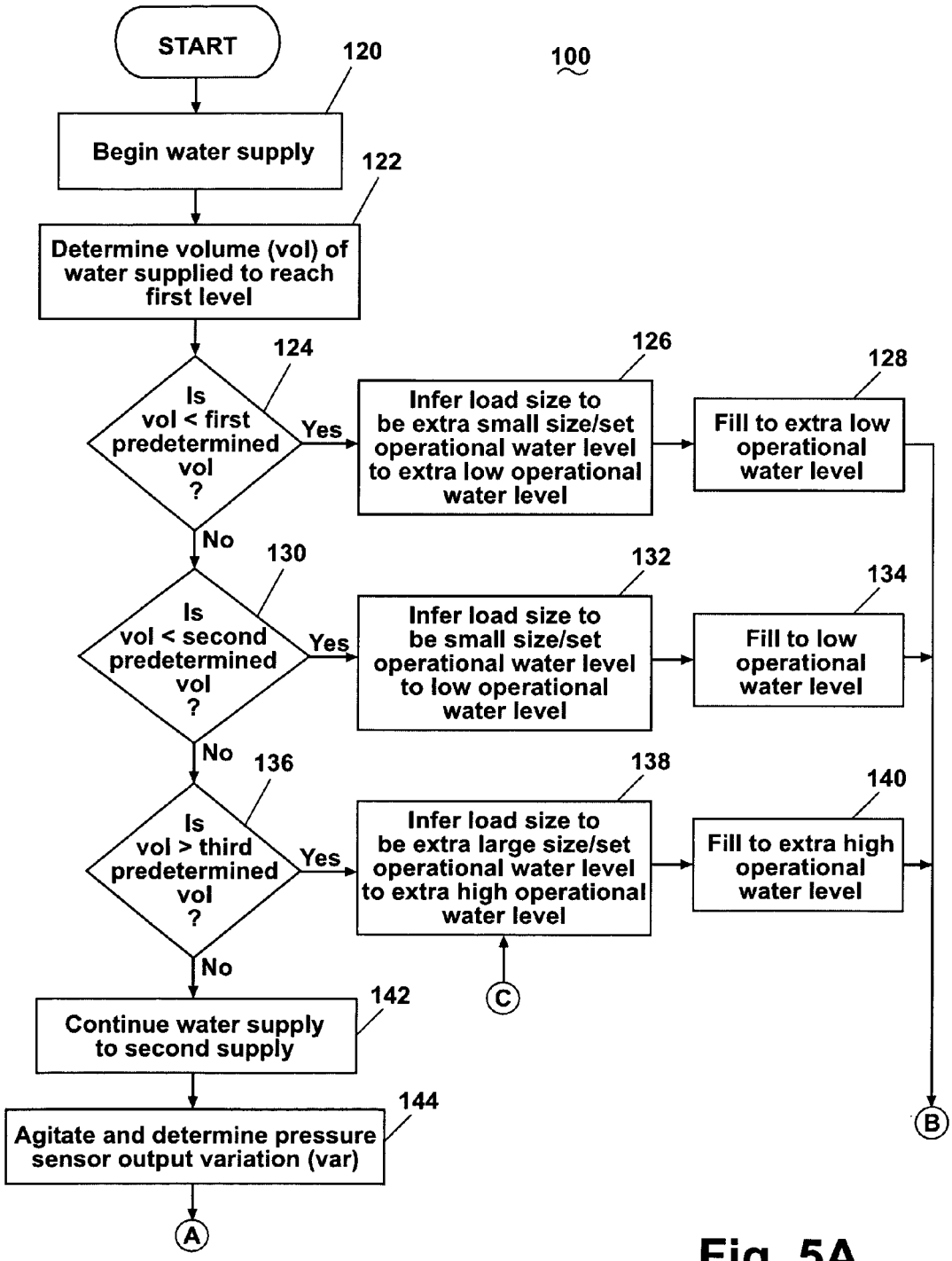
FIGS. 5A and 5B is an exemplary flow chart of an implementation of the method of FIG. 3 according to one embodiment of the invention.
Figure 5B:
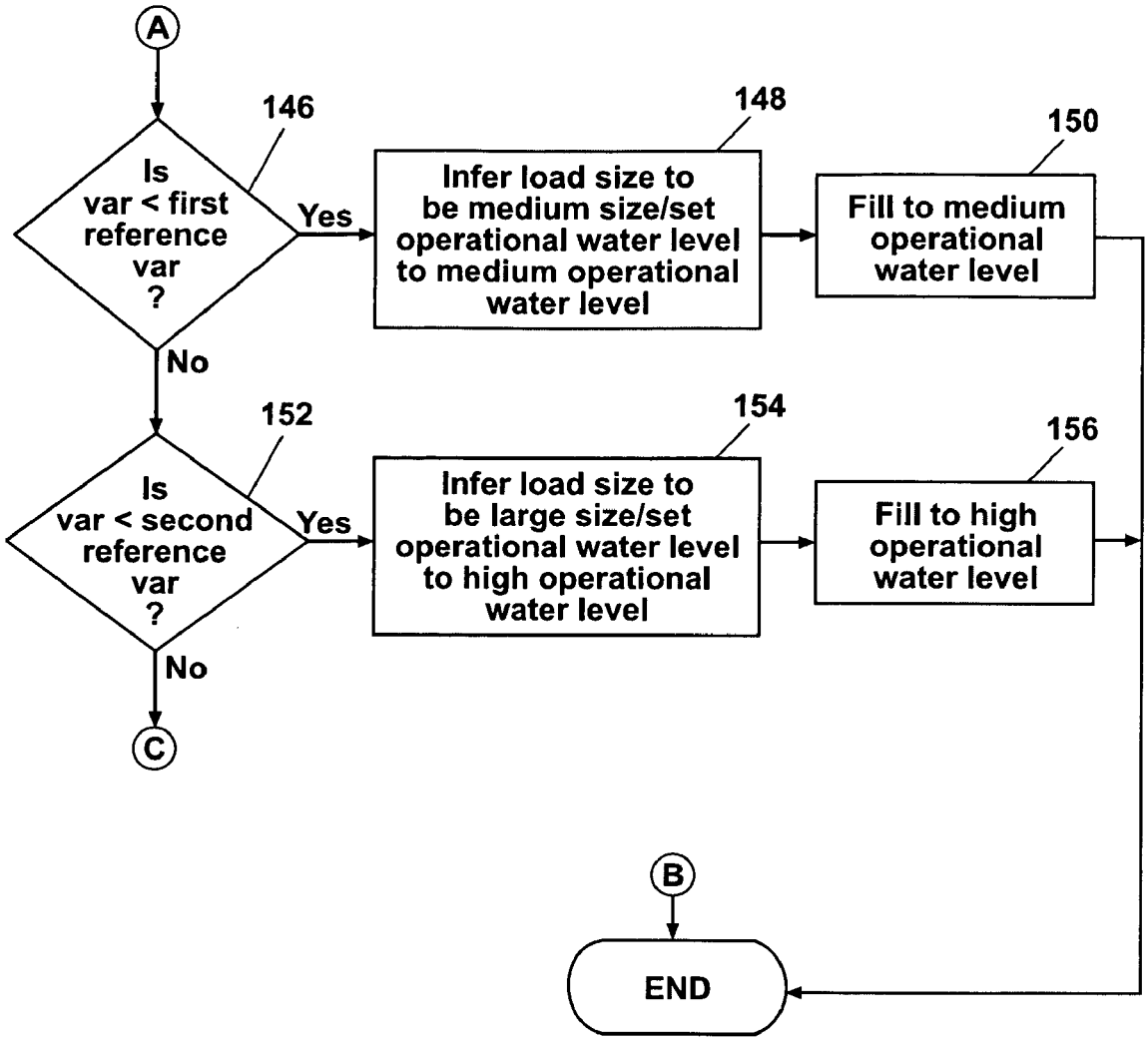

With this background, an exemplary implementation of the method in FIG. 3 will be described with respect to the flow chart in FIGS. 5A and 5B. The implementation of the method 100 includes a step 120 of beginning water supply to the tub 14. In one embodiment, the fabric load is typically in a dry or nearly dry condition in the basket 16 before the water is supplied, although in other embodiments the fabric load could be in varying degrees of wetness. During the initial supply of water to the tub 14 through the basket 16, the fabric load absorbs some of the water, and some of the water collects at the bottom of the tub 14.

Because the initial supplied volume may be indicative of whether the fabric load is relatively small and/or relatively large, the method 100 employs the initial supplied volume to determine whether the fabric load is relatively small and/or relatively large. In particular, for this example, the initial supplied volume is compared to three empirically determined predetermined volumes to determine whether the initial supplied volume is indicative of the first qualitative load size/the first operational water level. The initial supplied volume is compared to a first predetermined volume at a step 124, and if the initial supplied volume is less than the first predetermined volume, the fabric load is determined to be an extra small size and/or the operational water level is set to an extra low operational water level at a step 126. If the extra low operational water level is greater than the first level, then the water may be supplied to the extra low operational water level in a step 128. On the other hand, if the initial supplied volume is not less than the first predetermined volume, then the volume of water supplied is compared to a second predetermined volume, which is greater than the first predetermined volume, at a step 130. If the initial supplied volume is less than the second predetermined volume, the fabric load is determined to be a small size and/or the operational water level is set to a low operational water level at a step 132, and the water may be supplied to the low operational water level in a step 134. However, if the initial supplied volume is not less than the second predetermined volume, then the volume of water supplied is compared to a third predetermined volume, which is greater than the second predetermined volume, at a step 136. If the volume of water supplied is greater than the third predetermined volume, the fabric load is determined to be an extra large size and/or the operational water level is set to an extra high operational water level at a step 138, and the water may be supplied to the extra high operational water level in a step 140.

In this example, the first qualitative load size may be the extra small, small, and extra large size loads, each having a corresponding operational water level. Examples of the operational water levels include: extra low of about 7 inches, low of about 7.7 inches, and extra high of about 14 inches. These exemplary operational water levels are provided for illustrative purposes only and are not intended to limit the invention. Further, it is contemplated that the initial water supply to the first level, initial supplied volume, in the step 120 and the water supply to one of the first operational water levels, such as the extra low, low, and extra high operational water levels in the steps 128, 134, and 140 may be continuous or discrete. In other words, the evaluations at the steps 124, 130, and 136 may be made while the water supply continues or may be made while ceasing the water supply.

If it is determined that the initial supplied volume is not indicative of the first qualitative load size (in this example, the initial supplied volume is not less than the second predetermined volume and not greater than the third predetermined volume—i.e., between the second and third predetermined volumes), then the method 100 continues with supply of water in a step 142 to a second level. The second level may be any water level greater than the first level, and, in one embodiment, the second level may be about 7.4 inches of water in the tub 14. Further, the supply of water through the first level and to the second level may be continuous, such that the decisions in the steps 124, 130, and 136 occur while water is being supplied, or discrete, such that the water supply ceases while the decisions are made. At the second level, the agitator 18 (or other clothes mover) rotates to agitate the fabric load and the water in the tub 14 during a step 144. Additionally, an output from the pressure sensor 34 may be monitored and employed for determining whether the fabric load is the second qualitative load size. The agitation may occur for any suitable time, and an exemplary agitation time is about 15 seconds. The agitator 18 may rotate at any suitable speed, and, if the agitation comprises reciprocal rotation of the agitator 18, the agitator 18 may rotate in each direction for any suitable time.

Figure 6:
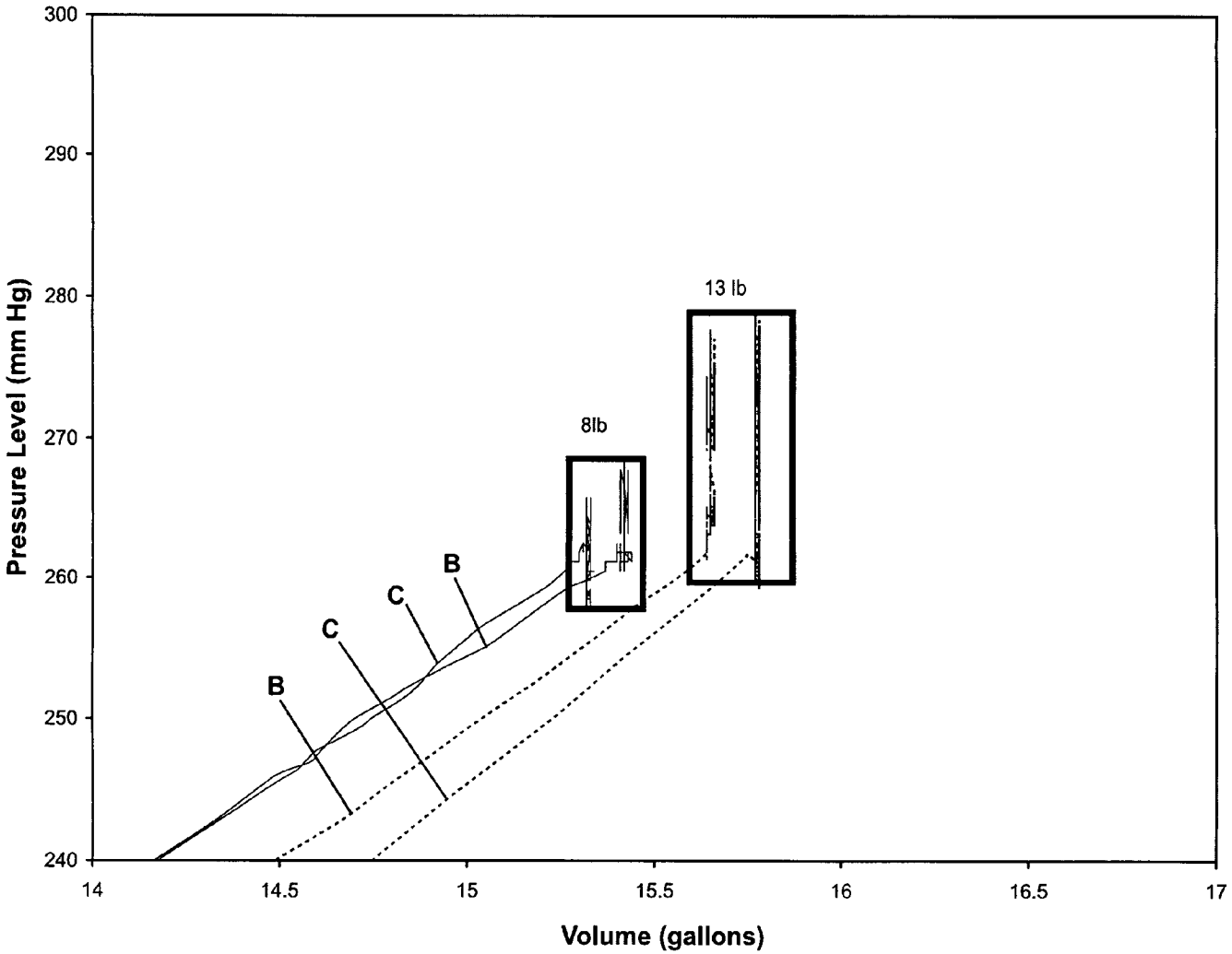
FIG. 6 is an exemplary graph of pressure level as a function volume of supplied water illustrating variation of the pressure level while agitating various fabric load weights having various fabric types.

Variation in the output signal from the pressure sensor 34 during agitation of the fabric load and the water in the tub 14 may be indicative of the load size. As the agitator 34 rotates, the fabric load moves, the water in the tub 14 moves and may splash, and the tub 14 itself may move or wiggle. One or more of these effects may result in a ripple or variation in the output from the pressure sensor 34, and the magnitude of the ripple or variation increases with increasing load size. This behavior can be seen in FIG. 6, which provides an exemplary graph of pressure level, which is the output from the pressure sensor 34 as a function of volume of water supplied to the tub 14 for fabric loads of 8 pounds (solid lines) and 13 pounds (dotted lines), with the blend loads denoted by "B" and the all cotton loads denoted by "C". For ease of viewing, transient variations in the actual test data have been removed from the plots and only the general trend is plotted. When the pressure level reaches a level indicative of the second level, which is slightly greater than 260 mm Hg in the exemplary graph, the agitation occurs and induces the variation in the pressure level. The variation, shown in the boxes on FIG. 6, in the output from the pressure sensor 34 is clearly smaller for the 8 pound loads, about 8 mm Hg, than for the 13 pound loads, about 15 mm Hg or greater. This variation is relatively independent of the type of the load.

Because the magnitude of the variation in the output from the pressure sensor 34 is indicative of the load size, the method 100 employs the variation to determine whether the fabric load is the second qualitative load size. In particular, for this example, the variation determined at the step 144 is compared to two empirically determined reference variations to determine whether the variation in the output of the pressure sensor 34 is indicative of the second qualitative load size/the second operational water level. Referring now to FIG. 5B, if the variation is determined at a step 146 to be less than a first reference variation, then the fabric load is determined to be a medium size and/or the operational water level is set to a medium operational water level at a step 148. The water may be supplied to the medium operational water level if the medium operational water level differs from the second level in a step 150. In one embodiment, the medium operational water level is equal to the second level, in which case, no further water supply occurs at the step 150. On the other hand, if the variation is determined not to be less than the first reference variation, then the variation is compared to a second reference variation at a step 152. If the variation is less than the second reference variation, then the fabric load is determined to be a large size and/or the operational water level is set to a high operational water level at a step 154, and the water may be supplied to the high operational water level in a step 156. However, if the variation is not less than the second reference variation, then the fabric load is determined to be the extra large size, whereby the method 100 goes to the step 138.

In one embodiment, the variation may be modified and compared to a reference modified variation. For example, the variation may be multiplied by a value representative of the volume of water supplied to the tub 14, such as a count of the flow meter, to achieve a better resolution of the data and, thereby, improve the assessment of load size and/or operational water level.

In this example, the second qualitative load size may be the medium, large, and extra large size loads, each having a corresponding operational water level. The extra large size, therefore, may be included in both the first and second qualitative load sizes for this example. Examples of the operational water levels include: medium of about 10 inches, high of about 12 inches, and extra high of about 14 inches. These exemplary operational water levels are provided for illustrative purposes only and are not intended to limit the invention.

After the load size is determined and/or the operational water level is set during one of the steps 126, 132, 138, 148, and 154, and, optionally, water supplied to the corresponding operational water level during one of the steps 128, 134, 140, 150, and 156, the process associated with the method 100 continues in any desired manner.

It is within the scope of the invention to utilize means other than or means in combination with the flow meter for determining the volume of water supplied to the tub 14 to reach the first level. By using the flow meter or other similar device, as compared to a more simple washing machine 10 lacking a flow meter or other similar device, more information may be available for determining load sizes and/or setting operational water levels. The information related to volume of water supplied enables the method 100 to employ a greater number of load sizes and/or operational water levels compared to a machine without the ability to determine the volume of water supplied to the tub 14.

In the method 100, the operational water level may be set without a corresponding determination of load size and vice-versa. It is contemplated that the method 100 may be employed only for setting the operational water level, in which case the determination of the load size may not be necessary. It is also contemplated that the method 100 may be employed for only determining the load size, and the determined load size may thereafter be employed to determine other parameters for the operation cycle. It is also contemplated for the method 100 to both determine the load size and set the operational water level. Further, the method 100 may be adapted for determining more or less than five load sizes, and, similarly, setting more or less than five operational water levels.

When the method 100 is employed for determining load size, the determined load size may be a qualitative load size wherein the fabric load is assigned to a category, such as small, medium, and large, of load size based on the qualities of the fabric load. That is, the size of the load is not weighed or otherwise to directly measured to obtain a quantitative or numerical measurement. While the qualitative load size does not correlate with a direct numerical measurement of the weight or volume of the fabric load, an estimated or empirical weight or weight range may be associated to the qualitative load size (e.g., a medium load size may be described as an 8-12 pound load size). Further, a qualitative load size, which, as described above, may be indicative of both the weight of the fabric load and the type of fabric load.

The volume of water supplied and the variation of the output from the pressure sensor 34 may be employed directly as a volume and a pressure level for the decisions made in the steps 124, 130, 136, 146, and 152 or may be modified in any suitable manner. In other words, the volume of water supplied and/or the pressure sensor output may be altered, such as by being multiplied by another variable, to refine the variables.

The method 100 may be adapted for use with different washing machines and differing water flow rates. Various aspects, such as the predetermined volumes and reference variations and number of load sizes and operational water levels, may depend on the configuration of the washing machine 10 and the external water supply. The particular shape of a curve of pressure level as a function of volume of water supplied may change for differing configurations of washing machines, but the relative behavior of pressure level as a function of volume of water supplied for a group of given fabric load weights and fabric types using a given washing machine configuration and a given water flow rate should remain the same or at least similar enough so that the method 100 may be applied regardless of the washing machine configuration and water flow rate.

The method 100 may be used for an automatic water level control system in lower end washing machine having simple electromechanical components, such as the flow meter. The method 100 may also be combined with a flow restrictor, alternate fill method, and/or inputs by the user, such as fabric type.

The above description and the figures refer to the supply of water to the tub 14. The water may be water alone or water in combination with an additive, such as a wash aid, including, but not limited to a detergent, a bleach, an oxidizer, a fabric softener, etc. Any additive supplied to the tub 14, either through a detergent dispenser or manually added directly into the basket 16 or the tub 14, may affect the output of the pressure sensor 34, and the empirically determined predetermined time and variation(s) may be set to account for such effects.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for determining a size of a fabric load in a washing machine comprising a wash tub, an agitator for agitating a fabric load in the tub, and a pressure sensor for sensing a level of water in the tub, the method comprising:

determining a volume of water supplied to the tub to reach a first level in the tub;

determining whether the determined volume of water is indicative of a first qualitative load size;

determining a first qualitative load size when the determined volume of water is indicative of the first qualitative load size; and determining a second qualitative load size of the fabric load based on a variation in an output of the pressure sensor during agitation of the fabric load with water in the tub at a level less than an operational water level for the second qualitative load size when the volume of water supplied is not indicative of the first qualitative load size.

2. The method according to claim 1 wherein the determining of the first qualitative load size comprises selecting the first qualitative load size from a group of first qualitative load sizes.

3. The method according to claim 2 wherein the group of first qualitative load sizes comprises an extra small load size and a small load size, and wherein the selecting of the first qualitative load size comprises determining that the fabric load is the extra small load size when the volume of water supplied is less than a first volume and determining that the fabric load is the small load size when the volume of water supplied is between the first volume and a second volume greater than the first volume.

4. The method according to claim 3 wherein the group of first qualitative load sizes further comprises an extra large load size, and wherein the selecting of the first qualitative load size further comprises determining that the fabric load is the extra large load size when the volume of water supplied is greater than a third volume that is greater than the first and second volumes.

5. The method according to claim 4 wherein the volume of water supplied is not indicative of the first qualitative load size when the volume of water supplied is between the second and third volumes.

6. The method according to claim 1 wherein the determining of the second qualitative load size comprises selecting the qualitative load size from a group of second qualitative load sizes.

7. The method according to claim 6 wherein the group of second qualitative load sizes comprises a medium load size and a large load size, and wherein the selecting of the second qualitative load size comprises determining that the fabric load is the medium load size when the pressure sensor output variation is less than a first reference variation and determining that the fabric load is the large load size when the pressure sensor output variation is greater than the first reference variation.

8. The method according to claim 7 wherein the selecting of the second qualitative load size comprises determining that the fabric load is the large load size when the pressure sensor output variation is between the first reference variation and a second reference variation greater than the first reference variation.

9. The method according to claim 8 wherein the group of second qualitative load sizes further comprises an extra large load size, and the selecting of the second qualitative load size comprises determining that the fabric load is the extra large load size when the pressure sensor output variation is greater than the second reference variation.

10. The method according to claim 1 wherein the second qualitative load size is greater than the first qualitative load size.

11. The method according to claim 1 wherein the first level in the tub is less than a washing level in the tub.

12. The method according to claim 1 wherein the determining of the second qualitative load size further comprises supplying water to a second level greater than the first level, rotating the agitator with the water at the second level, and determining the pressure sensor output variation during the rotation of the agitator.

13. The method according to claim 1, further comprising setting an operational water level in the tub to a first operational water level if the fabric load is determined to be the first qualitative size and setting the operational water level in the tub to a second operational water level greater than the first operational level if the fabric load is determined to be the second qualitative size.

14. A method for setting an operational water level in a washing machine comprising a wash tub for containing a fabric load, an agitator for agitating a fabric load in the tub, and a pressure sensor for sensing a level of water in the tub, the method comprising:

supplying water to the tub;

determining a volume of water supplied to reach a first level in the tub;

determining a first operational water level in the tub based on the determined volume of water supplied when the determined volume of water is indicative of a first operational water level; and when the volume of water supplied is not indicative of the first operational water level, determining a second operational water level based on a variation in a pressure sensor output caused by rotating the agitator at a water level less than the second operational water level.

15. The method according to claim 14 wherein the determining of the first operational water level comprises selecting the first operational water level from a group of first operational water levels.

16. The method according to claim 15 wherein the group of first operational water levels comprise an extra low operational water level and a low operational water level, and wherein the selecting of the first operational water level comprises setting the operational water level to the extra low operational water level when the volume of water supplied is less than a first volume and setting the operational water level to the low operational water level when the volume of water supplied is between the first volume and a second volume greater than the first volume.

17. The method according to claim 16 wherein the group of first operational water levels further comprise an extra high operational water level, and the selecting of the first operational water level further comprises setting the operational water level to the extra high operational water level when the volume of water supplied is greater than a third volume that is greater than the first and second volumes.

18. The method according to claim 17 wherein the volume of water supplied is not indicative of the first operational water level when the volume of water supplied is between the second and third volumes.

19. The method according to claim 14 where in the determining of the second operational water level comprises selecting the second operational water level from a group of second operational water levels.

20. The method according to claim 19 wherein the group of second operational water levels comprises a medium operational water level and a high operational water level, and wherein the selecting of the second operational water level comprises setting the operational water level to the medium operational water level when the pressure sensor output variation is less than a first reference variation and setting the operational water level to the high operational water level when the pressure sensor output variation is between the first reference variation and a second reference variation greater than the first reference variation.

21. The method according to claim 20 wherein the group of second operational water levels further comprises an extra high operational water level, and the selecting of the second operational water level comprises setting the operational water level to the extra high operational water level when the pressure sensor output variation is greater than the second reference variation.

22. The method according to claim 14 wherein the second operational water level is greater than the first operational water level.

23. The method according to claim 14 wherein the first level in the tub is less than a washing level in the tub.

24. The method according to claim 14, further comprising increasing the water from the first level in the tub to a second level in the tub, wherein the rotating of the agitator occurs with the water at the second level in the tub.

* * * * *